United States Patent [19]

Kide

[11] 4,052,177

[45] Oct. 4, 1977

[54] ELECTROSTATIC PRECIPITATOR ARRANGEMENTS

[75] Inventor: Leif Kide, Gothenburg, Sweden

[73] Assignee: Nea-Lindberg A/S, Denmark

[21] Appl. No.: 662,416

[22] Filed: Mar. 1, 1976

[30] Foreign Application Priority Data

Mar. 3, 1975 Denmark ..... 845/75

[51] Int. Cl.[2] ..... B03C 3/02

[52] U.S. Cl. ..... 55/139; 363/131

[58] Field of Search ..... 55/139; 34/45 R, 45 C, 34/44; 307/108

[56] References Cited

U.S. PATENT DOCUMENTS 3,849,670 11/1974 Lourigan ..... 307/108

3,981,695 9/1976 Fuchs ..... 55/139

FOREIGN PATENT DOCUMENTS 2,253,601 5/1974 Germany ..... 55/139

*Primary Examiner*—Bernard Nozick

*Attorney, Agent, or Firm*—Watson, Cole, Grindle & Watson

[57] ABSTRACT

An electrostatic precipitator arrangement comprises an oscillating circuit in which the precipitator is included as a capacitor, the circuit also including a storage capacitor and pulse initiating means, such as a thyristor or a spark gap, for causing the energy stored in the storage capacitor to oscillate from that capacitor to the precipitator and then through a diode or other electric valve means having the opposite direction of conduction back to the storage capacitor.

7 Claims, 6 Drawing Figures

ELECTROSTATIC PRECIPITATOR ARRANGEMENTS

BACKGROUND OF THE INVENTION

This invention relates to an electrostatic precipitator arrangement comprising a voltage generator applying pulses superposed on a unidirectional voltage to the electrodes of the precipitator, whereby the electrostatic precipitator becomes particularly suited for precipitating high resistive dust.

The system of applying a periodically variable voltage to electrostatic precipitators is known per se, as applied to both two- and three-electrode system precipitators, but this system has not yet been used to any large extent because the types of voltage supply so far known have not been capable of meeting the power and energy requirements of the repeated charging of the electrostatic precipitator.

SUMMARY OF THE INVENTION

According to the invention, an electrostatic precipitator of the kind described is characterized in that the electric circuit of the precipitator comprises means for returning the energy stored in the precipitator during the pulse to the voltage generator.

Thereby it becomes possible to reduce the energy and power consumption necessary for charging the electric capacitor represented by the electrostatic precipitator through recovery of the energy supplied thereto.

Pulse voltage operated electrostatic precipitators are first and foremost advantageous in the following respects:

The charging of the particles is improved because the peak value of the voltage can be raised without increase of the mean value of the voltage and thereby the number of flashovers. By varying the pulse amplitude and the pulse frequency it becomes possible to control the emission current independently of the electric main field so that the current load of the dust layer on the precipitation electrode can be adapted to the limit of re-radiation which is determined by the specific resistance of the dust.

The non-uniform current distribution of conventional precipitators gives rise to re-radiation if the precipitated dust is high resistive. By using pulse voltage operated three-electrode precipitators a very uniform current distribution over the precipitation electrode may be obtained when using extremely short voltage pulses with high amplitude because these can provide an electron cloud of high charge density and thereby high power of expansion. Thereby an improved distribution over the precipitation electrode of the emission current produced by each individual emission electrode is obtained.

Another well known problem in conventional electrostatic precipitators is that a few percent of the precipitator volume may seize almost 100% of the precipitator current owing to differences in gas conditions or re-radiation conditions internally in the precipitator. By using pulses a uniform distribution over the whole precipitator section may be obtained irrespective of local gas and re-radiation conditions because in the case of pulses of short duration and high amplitude the emission current is determined by the work of detaching the charge carriers from the emission electrode. This depends much on the emission electrode but only little on the surrounding gas.

A two-electrode precipitator in operation may from an electric point of view be considered equivalent to a capacitor having a resistor connected in parallel thereto or in series therewith and the energy supplied to the precipitator can therefore be divided into an active and a reactive part. The supply of active energy is an irreversible process, while the supply of reactive energy may be considered a reversible process. With the methods so far known it has, however, not been possible to recover the considerable energy which is stored in the capacity of an electrostatic precipitator during a pulse, but this energy has instead been converted into useless heat.

The quantitative size of this unnecessary energy consumption can be calculated from formula (1)

$$E\ 32\ \tfrac{1}{2} \cdot C \cdot (V_2^2 - V_1^2) \qquad (1)$$

where $C$ = capacity, $V_2$ = peak voltage, $V_1$ = starting voltage.

The corresponding power can be calculated from formula (2)

$$Q = \nu \cdot E \qquad (2)$$

where $\nu$ = the pulse repetition frequency.

Some examples of the calculated energy and power consumption for various capacity and voltage values are indicated below:

Table 1 a.

| | (Two-electrode system). | | | |
|---|---|---|---|---|
| | 1 | 2 | 3 | 4 |
| C nF | 70 | 150 | 70 | 150 |
| $V_m$ kV | 50 | 50 | 50 | 50 |
| $V_p$ kV | 20 | 20 | 100 | 100 |
| E Joule | 85 | 180 | 700 | 1500 |
| Q kW | 35 | 75 | 280 | 600 |

where
C = capacity of the precipitator,
$V_m$ = D.C. voltage,
$V_p$ = superposed pulse voltage
E = energy consumption for a single charge,
Q = power consumption (at a pulse repetition frequency of 400 Hz).

Table 1 b.

| | | (Three-electrode system). | | | | |
|---|---|---|---|---|---|---|
| | | 1 | 2 | 3 | 4 | 5 |
| $C_{EH}$ | nF | 100 | 160 | 160 | 160 | 160 |
| $C_{EU}$ | nF | 30 | 80 | 80 | 80 | 80 |
| $V_{HU}$ | kV | 50 | 50 | 50 | 50 | 50 |
| $V_{EU}$ | kV | 50 | 50 | 50 | 50 | 30 |
| $V_P$ | kV | 50 | 20 | 50 | 100 | 50 |
| E | J | 240 | 130 | 500 | 1600 | 660 |
| Q | kW | 95 | 50 | 200 | 640 | 265 |

where
$C_{EH}$ = capacity emission-auxiliary electrode,
$C_{EU}$ = capacity emission-precipitation electrode,
$V_{HU}$ = D.C. voltage between auxiliary and precipitation electrode,
$V_{EU}$ = D.C. current between emission and precipitaton electrode,
$V_P$ = superposed pulse voltage,
E = energy consumption for a single charge,
Q = power consumption (at a pulse repetition frequency of 400 Hz).

As will be seen from the tables, the power consumption of big precipitators (more than 2500 m² precipitation electrode area) at high pulse voltages reaches values from 200–600 kW. Since a conventional precipitator only utilizes 10% of this power, it will be realized that the pulse operation of electrostatic precipitators cannot, for reasons of economy, be utilized on an industrial scale, if the energy of the individual pulses is not recovered in an efficient way.

Besides reducing the energy consumption of the electrostatic precipitator the invention also aims at ensuring the quenching of the corona discharges after each pulse.

In order to control the charging current and, in the three-electrode system also the current distribution over the precipitation electrode, it is in fact necessary to be able to control the time function of the corona current. The emission current depends not only on the instantaneous value of the precipitator voltage, but also on whether an ionized plasma is advance present in the immediate vicinity of the emission electrode, because in that case the tendency towards new ionization will be increased so that new charge carriers will be formed at a relatively low field strength. Thus, it is a further characteristic of the invention that quenching of the corona discharge can be ensured by lowering the voltage below the main voltage for a short time after each pulse.

In a preferred embodiment of the invention, the means for recovering the pulse energy comprises an LC-oscillating circuit including the precipitator as a capacitive element and further including a storage capacitor, pulse initiating means having one direction of conduction, and electric valve means having the opposite direction of conduction.

Thus, in each pulse energy is supplied from the storage capacitor, serving as an energy reservoir, via the pulse initiating means, which may e.g. be a thyristor or thyristor combination or a spark gap, to the electrostatic precipitator and then via the valve means, which may e.g. be a diode or diode combination, back to the storage capacitor.

DESCRIPTION OF THE PREFERRED EMBODIMENTS

Figure 1:
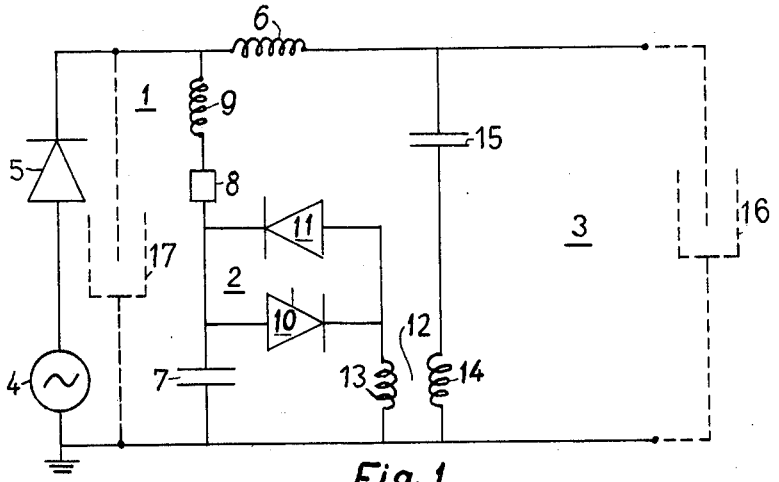
FIG. 1 is a circuit diagram of a pulse generator for the operation of an electrostatic precipitator according to a first embodiment of the invention.

In FIG. 1, 1 is a charging circuit for a storage capacitor 7. 2 is a discharging circuit in which the pulses are generated, and 2 in combination with 3 constitute the circuit in which they oscillate.

From a voltage supply source 4, which may be one-phase or multi-phase, a one- or multi-phase AC voltage is obtained which is rectified by means of a rectifier 5 (which may e.g. be a one- or multi-phase bridge coupling). A coil 6 isolates the DC voltage source from current transients resulting from the pulse generator, while permitting a DC supply of an electrode combination 16 representing the emission electrode and the precipitation electrode of an electrostatic precipitator, e.g. of the well known type serving as a gas filter to precipitate dust particles from a flowing gas. 7 is a capacitor from which the energy for the pulses is drawn and to which it is subsequently restored. For starting up the generator and for compensating for the energy, which is consumed during each pulse partly in the corona discharge and partly as losses in components and conductors, it is necessary to be able to supply new energy to the capacitor. This takes place through a current limiting resistor 8 and a coil 9. 10 is a thyristor which can be switched on by means of a switching circuit, not shown. When this takes place, the charge of the capacitor 7 oscillates through a pulse transformer 12 having a primary winding 13 and a secondary winding 14, to a capacitor 15 and to the electrode combination 16, and back through a diode (or diode combination) 11, the direction of conduction of which is opposite to that of the thyristor, to the capacitor 7. The period of oscillation is determined by the short circuit inductance of the pulse transformer 12 and the capacity values of the capacitors 7 and 15 as well as the capacity value of the electrode combination 16. The capacitor 15 is included in the generator in order to avoid DC current through the secondary winding 14 of the pulse transformer 12 and must be so adjusted relative to the capacity of the electrostatic precipitator 16 that the pulse voltage amplitude is divided between the two capacities in a reasonable proportion.

Figure 5:
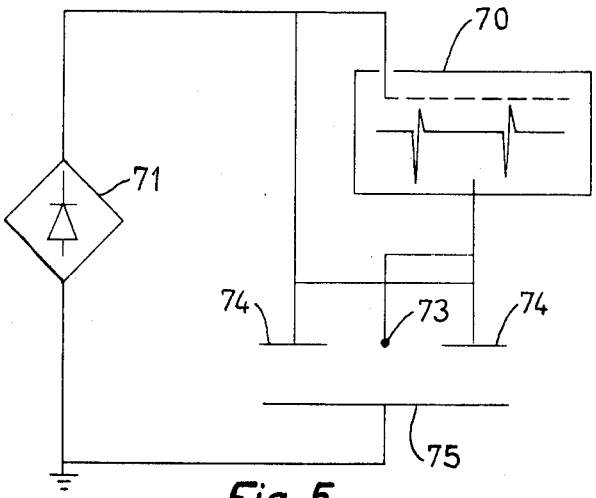
FIG. 5 is a circuit diagram of a pulse generator for the operation of an electrostatic precipitator according to a fifth embodiment of the invention.

FIG. 1 also shows the utilization of the circuit 1 for supplying an additional electrode combination 17 which may represent the auxiliary electrode and the precipitation electrode of a three-electrode precipitator, cf. FIG. 5.

Figure 2:
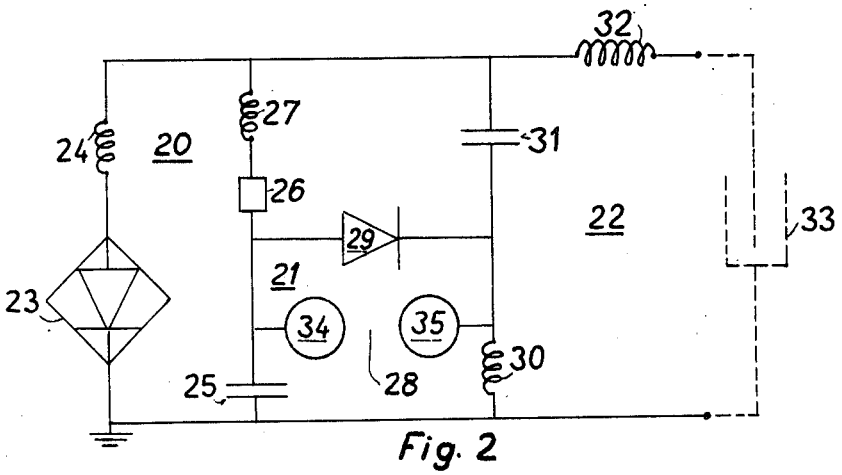
FIG. 2 is a circuit diagram of a pulse generator for the operation of an electrostatic precipitator according to a second embodiment of the invention.

In FIG. 2, 20 is a charging circuit for a capacitor 25, and 21 is a discharging circuit in which the pulses are generated, while 21 in combination with 22 represents the circuit in which the pulses oscillate.

23 is a high voltage DC source, the positive terminal of which is grounded so that a negative voltage may be taken out from the source. A coil 24 isolates the voltage source 23 from current transients resulting from the pulse generator. 25 is a capacitor, from which the energy for the pulses is drawn and to which it subsequently restored. For the starting up of the generator and for compensating for the energy which is consumed in each pulse partly in corona discharge and partly in losses in components and conductors it is necessary to supply new energy to the capacitor. This is obtained by a charging network consisting of a current limiting resistor 26 and a coil 27. When flashover takes place in a spark gap 28 formed between two sparking electrodes 34 and 35, the charge of the capacitor 25 oscillates through the spark gap 28 and a coil 32 to a capacitor 31 and to an electrode combination 33 representing an electrostatic precipitator, and then back to the capacitor 25 via a diode (or diode combination) 29. The flashover of the spark gap 28 may be effected either by adjustment of the spark gap for self-flashing at a predetermined threshold voltage, or by providing some form of triggering of the spark gap, e.g. by exposing the spark gap to ultraviolet light. If the spark gap is self-flashing, the oscillation must be so strongly attenuated that the gap does not re-flash after the pulse voltage has oscillated back to the capacitor 25. For this type of spark gap the pulse repetition frequency is determined by the time constant of the charging network 26, 27 and the capacitor 25. A coil 30 serves to keep one side of the spark gap grounded in respect of DC, but isolated from ground to sufficiently high frequencies. The capacitor 31 is included in the generator in order to avoid DC current from the DC source through the coil 30, and it must be so adjusted relative to the capacity of the electrostatic precipitator 33 that the pulse voltage amplitude is divided between the two capacities in a reasonable proportion. The period of oscillation produced by flashover of the spark gap 28 is determined by the inductance of the coil 32 and the capacity values of the capacitors 25 and 31 as well as the capacity value of the electrostatic precipitator 33.

Figure 3:
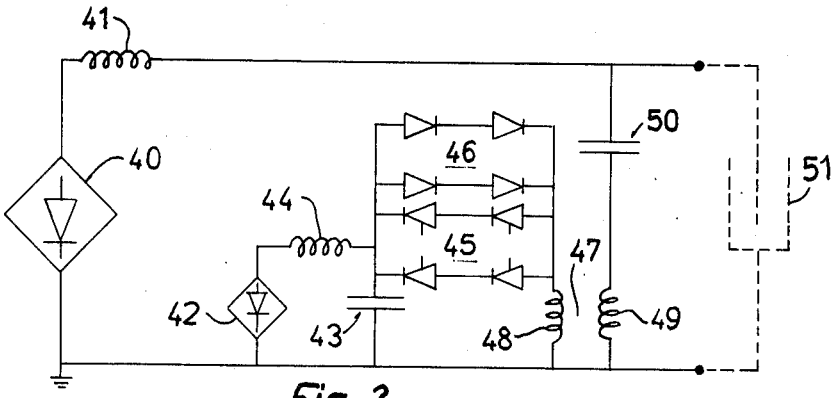
FIG. 3 is a circuit diagram of a pulse generator for the operation of an electrostatic precipitator according to a third embodiment of the invention.

In FIG. 3, 40 is a high voltage DC source, the positive terminal of which is grounded so that a negative voltage can be taken out from the source. This voltage is supplied via a coil 41 to an electrode combination 51 representing an electrostatic precipitator and thereby determines the mean value of the voltage across the electrostatic precipitator. A coil 41 serves to isolate the voltage source 40 from current transients resulting from the pulse generation. 43 is a condenser from which the energy for the pulses is drawn and to which it is again restored. As contrasted to the pulse generators constituted by the circuits in FIGS. 1 and 2, the pulse generation in the case of FIG. 3 takes place independently of the DC supply of the precipitator 51. In the circuit of FIG. 3, a separate DC source 42 serves to charge a storage capacitor 43 in starting up the generator and for compensating for the energy consumed in each pulse partly in the corona discharge and partly as losses in components and conductors. The positive terminal of the voltage source 42 is grounded, so that a negative voltage can be taken out from the voltage source. A coil 44 serves both to limit the current (current increase) from the DC voltage 42 to the capacitor 43 and to isolate the voltage source from current transients resulting from the pulse generation. When a thyristor combination 45 is switched on, the charge on the capacitor 43 oscillates through a pulse transformer 47 having a primary winding 48 and a secondary winding 49 to a capacitor 50 and the precipitator 51 and back through the diode combination 46, the direction of conduction of which is opposite to that of the thyristor valve combination, to the capacitor 43. The period of the oscillation is determined by the short-circuit inductance of the pulse transformer 47 and the capacity values of the capacitors 43 and 50 as well as the capacity value of the precipitator 51. The capacitor 50 is included in the generator in order to avoid DC current through the secondary winding 49 of the pulse transformer 47 and must be so adjusted relative to the capacity of the precipitator 51 that the pulse voltage amplitude is divided between the two capacities in a reasonable proportion.

Figure 4:
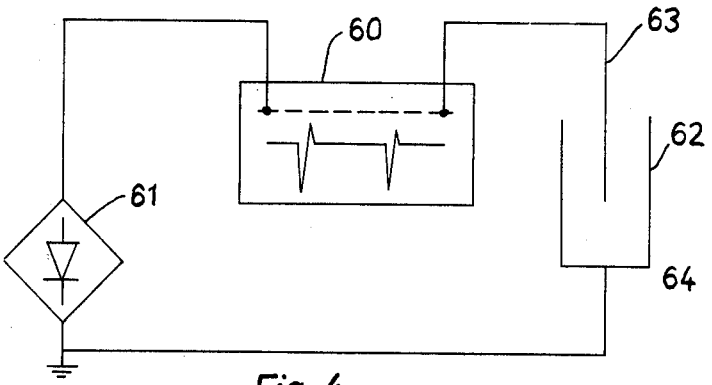
FIG. 4 is a circuit diagram of a pulse generator for the operation of an electrostatic precipitator according to a fourth embodiment of the invention.

In FIG. 4, 60 represents a pulse generator e.g. as described in FIG. 2 or 3. As shown in the figure, the pulse generator 60 is connected between a DC source 61 and the emission electrode 63 of an electrostatic precipitator 62, and may either be self-supplying as shown in FIG. 2 or require a separate supply as shown in FIG. 3. The positive terminal of the DC source being grounded together with the precipitation electrode 64 of the precipitator, a negative voltage is applied to the emission electrode.

In FIG. 5, 70 represents a pulse generator e.g. as described with reference to FIG. 1. As shown in the figure, the pulse generator 70 is connected between a DC source 71 and the emission electrode 73 of an electrostatic precipitator 72 and may either be self-supplying as illustrated in FIG. 1 or require a separate supply. An auxiliary electrode 74 of the precipitator 72 is connected directly to the DC source 71 and the difference of potential between the auxiliary electrode 74 and the emission electrode 73 will therefore be constituted by the pulse voltage. The negative terminal of the DC source being grounded together with the precipitation electrode 75 of the precipitator, both the emission and the auxiliary electrode are supplied with positive voltages.

Figure 6:
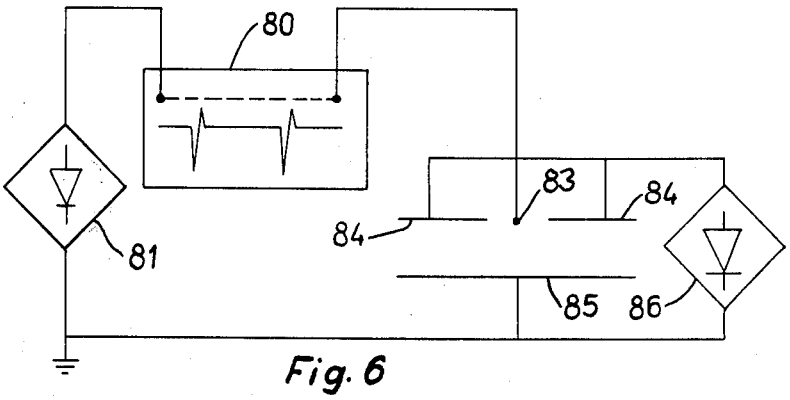
FIG. 6 is a circuit diagram of a pulse generator for the operation of an electrostatic precipitator according to a sixth embodiment of the invention.

In FIG. 6, 80 is a pulse generator e.g. as described in FIG. 2 or 3. As shown in the drawing, the pulse generator 80 is connected between a DC source 81 and the emission electrode 83 of an electrostatic precipitator 82 and may either be self-supplying as illustrated in FIG. 2 or require a separate supply as illustrated in FIG. 3. The precipitator also has an auxiliary electrode 84 which is connected to a separate DC source 86, and the difference of potential between the auxiliary electrode 84 and the emission electrode 83 will therefore be equal to the pulse voltage suspended on a DC voltage. The positive terminals of both DC sources being grounded together with the precipitation electrode 84 of the precipitator, both the emission electrode and the auxiliary electrode are supplied with negative voltages.

The examples described above with reference to the drawings only serve for illustrating the invention and are by no means limitative of the scope of the invention.

By suitable arrangements the pulse generators as described above may also be used for supplying a plurality of precipitator sections so that in the case of a sectioned electrostatic precipitator it will suffice to use one pulse generator.

I claim:

1. An electrostatic precipitator circuit, comprising:

a voltage source for generating a unidirectional voltage;

precipitator electrodes constituting a capacitor and responsive to said inidirectional voltage;

a pulse generator including a storage capacitor for generating pulses;

inductance means intercoupled between said storage capacitor and said precipitator electrode capacitor for transferring said pulses to said precipitator electrodes in superimposed relationship to said unidirectional voltage;

said storage capacitor, inductance means and said precipitator electrode capacitor forming a controllable LC oscillating circuit; and non-linear electric means for controlling said LC oscillating circuit to enable the energy stored in said precipitator electrode capacitor during each pulse transferred thereto to return to said storage capacitor for renewed storage therein.

2. An electrostatic precipitator circuit as in claim 1 wherein said inductance means includes a pulse transformer having a self-inductance forming at least a part of the self-induction of said LC oscillating circuit.

3. An electrostatic precipitator circuit as in claim 2 further comprising a charging circuit connected to said voltage source and wherein said storage capacitor forms part of said charging circuit.

4. An electrostatic precipitator circuit as in claim 2 further comprising an additional voltage source for providing an additional unidirectional voltage, and a charging circuit, said storage capacitor forming part of said charging circuit and said additional unidirectional voltage being supplied thereto independently of said unidirectional voltage from said first mentioned voltage source.

5. An electrostatic precipitator circuit as in claim 1 wherein said inductance means includes a series connection of self-induction coils, some of said coils being connected in series in the energy supply to the precipitator and the remaining coils being shunted by said non-linear electric elements and said storage capacitor.

6. An electrostatic precipitator circuit as in claim 5 further comprising a charging circuit connected to said voltage source, and wherein said storage capacitor forms part of said charging circuit.

7. An electrostatic precipitator circuit as in claim 5 further comprising an additional voltage source for providing an additional unidirectional voltage, and a charging circuit, said storage capacitor forming part of said charging circuit and said additional unidirectional voltage being supplied thereto independently of said unidirectional voltage from said first mentioned voltage source.

* * * * *